US011482355B2

(12) United States Patent
Saito et al.

(10) Patent No.: US 11,482,355 B2
(45) Date of Patent: Oct. 25, 2022

(54) SOFT MAGNETIC ALLOY

(71) Applicant: DAIDO STEEL CO., LTD., Nagoya (JP)

(72) Inventors: Akihiko Saito, Nagoya (JP); Takeshi Takano, Nagoya (JP); Yu Nakama, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 514 days.

(21) Appl. No.: 15/643,326

(22) Filed: Jul. 6, 2017

(65) Prior Publication Data

US 2018/0012687 A1 Jan. 11, 2018

(30) Foreign Application Priority Data

Jul. 11, 2016 (JP) ..... JP2016-136661
Jun. 14, 2017 (JP) ..... JP2017-116521

(51) Int. Cl.

| | |
|---|---|
| ***C22C 38/06*** | (2006.01) |
| ***H01F 1/147*** | (2006.01) |
| ***C22C 38/02*** | (2006.01) |
| ***C22C 38/44*** | (2006.01) |
| ***C22C 38/46*** | (2006.01) |

(52) U.S. Cl.

CPC ..... *H01F 1/14708* (2013.01); *C22C 38/02* (2013.01); *C22C 38/06* (2013.01); *C22C 38/44* (2013.01); *C22C 38/46* (2013.01); *C22C 2202/02* (2013.01)

(58) Field of Classification Search

CPC ..... C22C 38/06
See application file for complete search history.

(56) References Cited

U.S. PATENT DOCUMENTS

| | | | | |
|---|---|---|---|---|
| 2,027,995 | A | 1/1936 | Mishima | |
| 3,723,103 | A | 3/1973 | Kato et al. | |
| 3,844,849 | A | 10/1974 | Kuroda | |
| 4,131,494 | A | 12/1978 | Momose et al. | |
| 4,398,972 | A * | 8/1983 | Bordelon | H01F 1/14708 148/310 |
| 2009/0202383 | A1* | 8/2009 | Tanaka | C22C 38/004 148/624 |
| 2013/0136933 | A1 | 5/2013 | Matsutani et al. | |

FOREIGN PATENT DOCUMENTS

| | | | | |
|---|---|---|---|---|
| CN | 101710521 | A | 5/2010 | |
| CN | 102619569 | A | 8/2012 | |
| CN | 102982956 | A | 3/2013 | |
| CN | 103774047 | A | 5/2014 | |
| EP | 2 479 380 | A1 | 7/2012 | |
| EP | 2 722 406 | A1 | 4/2014 | |
| JP | H01-184250 | A | 7/1989 | |
| JP | 01294847 | A * | 11/1989 | H01F 1/153 |
| JP | 2000-160302 | A | 6/2000 | |
| JP | 2000-169944 | A | 6/2000 | |
| JP | 2000-345292 | A | 12/2000 | |
| JP | 2006-193779 | A | 7/2006 | |
| WO | WO 2012/001943 | A1 | 1/2012 | |

OTHER PUBLICATIONS

English machine translation of JP 01-294847A of Sawa (published Nov. 1989) (Year: 1989).*
English machine translation of JP 2000-160302 A of Takada published Jun. 2000 (Year: 2000).*
Chinese Office Action, dated Dec. 28, 2018, in Chinese Application No. 201710562865.0 and English Translation thereof.
Thermodynamic modeling and experimental validation of the Fe—Al—Ni—Cr—Mo alloy system, Z. K. Teng ,等, Materials Letters, 第 36-40 页 • 2011年11月 23 日.
Chinese Office Action, dated Sep. 30, 2019, in Chinese Application No. 201710562865.0 and English Translation thereof.
Japanese Office Action, dated Nov. 17, 2020, in Japanese Application No. 2017-116521 and English Translation thereof.
Indian Office Action, dated Jan. 1, 2021, in Indian Patent Application No. 201714024221.
Hearing Report, dated Aug. 16, 2021, in Indian Application No. 201714024221 and English Translation thereof.

* cited by examiner

*Primary Examiner* — Jophy S. Koshy
(74) *Attorney, Agent, or Firm* — McGinn I.P. Law Group, PLLC.

(57) ABSTRACT

The present invention relates to a soft magnetic alloy containing: Ni, and at least one element selected from the group consisting of Al, Si and V, with the balance being Fe and inevitable impurities, in which, when the content of Ni and the total content of Al, Si and V are expressed by [Ni] and [M], respectively in mass %, and a relationship between [Ni] and [M] is plotted, the coordinate ([Ni], [M]) is present in a region surrounded by the straight lines A, B, C, D, and E.

7 Claims, 1 Drawing Sheet

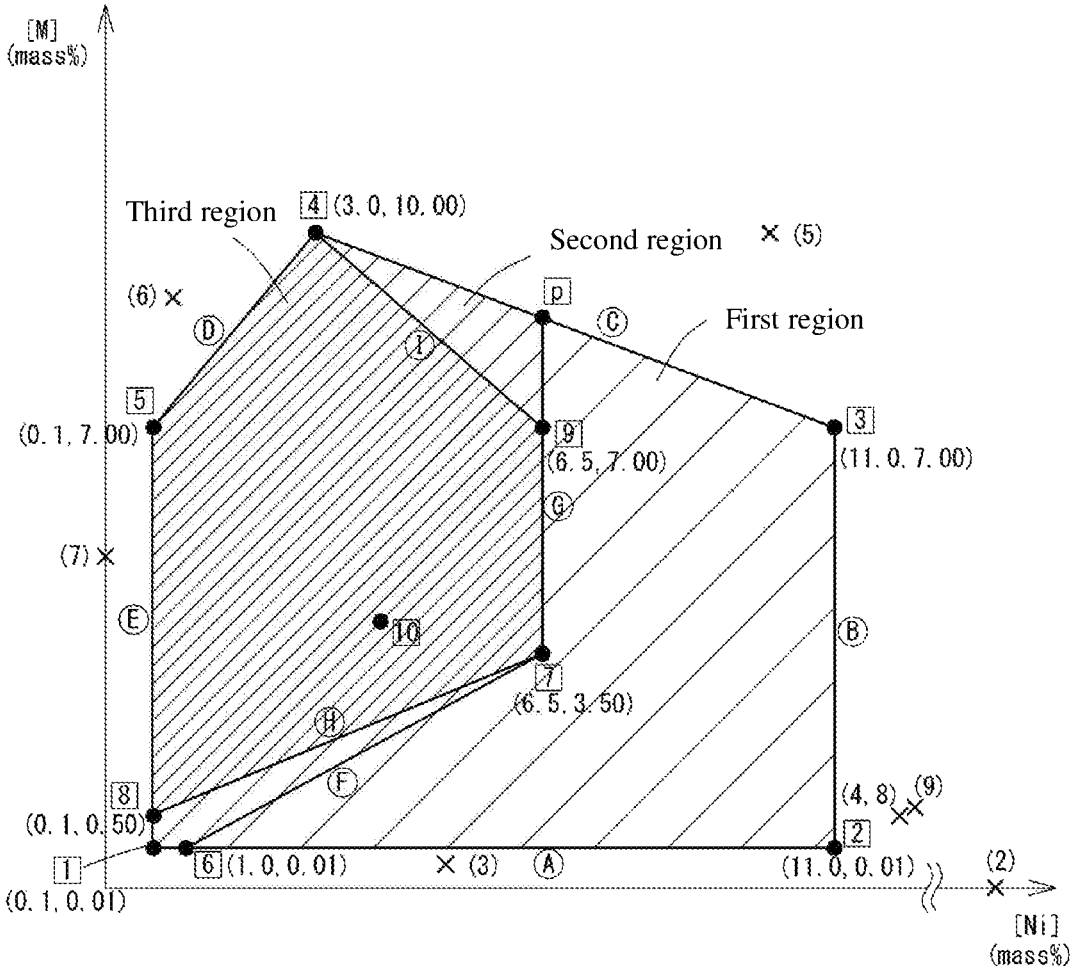
[M]
(mass%)
Third region
4 (3. 0, 10. 00)
Second region
× (5)
(6) ×
D
p
C
First region
I
5
(0. 1, 7. 00)
9
(6. 5, 7. 00)
3
(11. 0, 7. 00)
G
(7) ×
E
10
B
7
(6. 5, 3. 50)
H
F
8
(0. 1, 0. 50)
(4, 8)
(9)
2
1
6 (1. 0, 0. 01)
× (3)
A
(11. 0, 0. 01)
(2)
(0. 1, 0. 01)
[Ni]
(mass%)

SOFT MAGNETIC ALLOY

TECHNICAL FIELD

The present invention relates to a soft magnetic alloy, and more specifically, relates to a soft magnetic iron-based alloy that can obtain high magnetic flux density.

BACKGROUND ART

Soft magnetic materials have been widely used as materials forming electric equipment such as a motor. With the recent tendency of the reduction in size of the electric equipment and increase of a current accompanied therewith, high magnetic flux density has been required in the soft magnetic materials. Furthermore, with the increase of the current density, excellent soft magnetic characteristics, that is, a low coercive force and a behavior that the magnetic flux density does not tend to be saturated, are required for the soft magnetic materials in a region of high magnetic field intensity.

For example, if the value of a current flowing in a coil constituting a motor is set to be doubled, it is possible to halve the number of turns of the coil, which is necessary for obtaining the same output, and thus it is possible to achieve the reduction in size of the motor. For this, it is necessary that magnetic flux density of a soft magnetic material forming an iron core is not saturated at the magnetic field intensity corresponding to the current value. If the magnetic flux density of the soft magnetic material forming the iron core is able to be doubled, it is also possible to obtain the same magnetic flux even if the cross-sectional area of the iron core is halved. Thus, it is possible to reduce the size of the entirety of a motor.

Pure iron is known as a soft magnetic material having high magnetic flux density. Permendur which is a Fe—Co alloy is known as a soft magnetic material having magnetic flux density which is larger than that of pure iron. In addition to the permendur, a soft magnetic alloy which contains Co and has high magnetic flux density is also known. For example, Patent Document 1 discloses an iron-based alloy containing 25.0 mass % or more and less than 30.0 mass % of Co and other additive elements. Additionally, an electromagnetic steel sheet (silicon steel sheet) being an iron-based alloy containing Si is known as a typical soft magnetic material.

Patent Document 1: JP-A-2006-193779

SUMMARY OF THE INVENTION

In recent years, residual magnetic flux density (Br) of a permanent magnet used in a motor has increased. Therefore, a soft magnetic material forming an iron core or a yoke is also required to follow such high magnetic flux density, and is required to have large saturated magnetic flux density. A Fe—Co alloy represented by permendur is able to realize high magnetic flux density. However, because of a large content of Co, the Fe—Co alloy is very expensive and has poor workability in many cases. The electromagnetic steel sheet is cheap and shows relatively high magnetic permeability, but magnetic flux density thereof is not so high. For example, it is difficult for the electromagnetic steel sheet to achieve magnetic flux density of 1.7 T or larger.

An object of the present invention to be solved is to provide a soft magnetic alloy which has high saturated magnetic flux density and is cheap.

To solve the above problem, the present invention provides a soft magnetic alloy containing:

Ni, and at least one element selected from the group consisting of Al, Si and V, with the balance being Fe and inevitable impurities, in which, when the content of Ni and the total content of Al, Si and V are expressed by [Ni] and [M], respectively in mass %, and a relationship between [Ni] and [M] is plotted, the coordinate ([Ni], [M]) is present in a region surrounded by the following straight line A, the following straight line B, the following straight line C, the following straight line D, and the following straight line E:

Straight line A: [M]=0.01;

Straight line B: [Ni]=11.0;

Straight line C: a straight line connecting a point at which ([Ni], [M]) is (11.0, 7.00) and a point at which ([Ni], [M]) is (3.0, 10.00);

Straight line D: a straight line connecting a point at which ([Ni], [M]) is (3.0, 10.00) and a point at which ([Ni], [M]) is (0.1, 7.00); and Straight line E: [Ni]=0.1.

It is preferable that the coordinate ([Ni], [M]) is present in a region surrounded by the straight line A, the straight line C, the straight line D, the straight line E, the following straight line F, and the following straight line G:

Straight line F: a straight line connecting a point at which ([Ni], [M]) is (1.0, 0.01) and a point at which ([Ni], [M]) is (6.5, 3.50); and Straight line G: [Ni]=6.5.

Furthermore, in this case, it is more preferable that the coordinate ([Ni], [M]) is present in a region surrounded by the straight line D, the straight line E, the straight line G, the following straight line H, and the following straight line I:

Straight line H: a straight line connecting a point at which ([Ni], [M]) is (0.1, 0.50) and the point at which ([Ni], [M]) is (6.5, 3.50); and Straight line I: a straight line connecting a point at which ([Ni], [M]) is (6.5, 7.00) and the point at which ([Ni], [M]) is (3.0, 10.00).

The soft magnetic alloy may further contain, in mass %:

$1\% \leq Cr \leq 14\%$.

The soft magnetic alloy may further contain, in mass %:

$1\% \leq Mo \leq 6\%$.

In this case, the soft magnetic alloy may further contain Cr and Mo, and satisfies $1\% \leq Cr+3.3Mo \leq 14\%$ in mass %.

The soft magnetic alloy may further contain, in mass %, at least one element selected from the group consisting of:

$0.03\% \leq Pb \leq 0.30\%$, $0.002\% \leq Bi \leq 0.020\%$, $0.002\% \leq Ca \leq 0.20\%$, $0.01\% \leq Te \leq 0.20\%$, and $0.03\% \leq Se \leq 0.30\%$.

The soft magnetic alloy preferably has a Vickers hardness Hv of 250 or higher.

The soft magnetic alloy according to the present invention has a component composition where the coordinate ([Ni], [M]) is falling within the region surrounded by the straight lines A to E in the [Ni]-[M] coordinate system, and thus has such a high saturated magnetic flux density of 1.7 T or higher. At the same time, it is possible to achieve such a low coercive force of 1,000 A/m or lower. Thus, an excellent soft magnetic alloy having both of high saturated magnetic flux density and low coercive force can be obtained. Since the component composition does not contain a lot of expensive additive elements such as Co, the soft magnetic alloy can be produced cheaply.

Here, in the case where the soft magnetic alloy has a component composition where the coordinate ([Ni], [M]) is falling within the region surrounded by the straight lines A, C, D, E, F, and G, the lower coercive force is easily achieved.

In this case, in the case where the soft magnetic alloy has a component composition where the coordinate ([Ni], [M]) is falling within the region surrounded by the straight lines D, E, G, H, and I, the lower coercive force is more easily achieved.

In the case where the soft magnetic alloy contains Cr and/or Mo of the above-described amount, it is possible to obtain a soft magnetic alloy having high electric resistance and high corrosion resistance in addition to the low coercive force and high saturated magnetic flux density.

In the case where the soft magnetic alloy contains at least one element selected from the group consisting of Pb, Bi, Ca, Te, and Se of the above-described amount, machinability of the soft magnetic alloy can be favorably improved.

In the case where the soft magnetic alloy has a Vickers hardness Hv of 250 or higher, it is possible to achieve both strength as a material and excellent soft magnetic characteristics.

BRIEF DESCRIPTION OF THE DRAWING

FIG. 1 is a graph plotting the content of Ni and the total content of Al, Si and V in a soft magnetic alloy according to an embodiment of the present invention.

MODE FOR CARRYING OUT THE INVENTION

Hereinafter, a soft magnetic alloy according to an embodiment of the present invention will be described in detail.

(Outline of Soft Magnetic Alloy)

The soft magnetic alloy according to the embodiment of the present invention contains the following elements and the remainder consisting of Fe and inevitable impurities:

Ni; and at least one element selected from the group consisting of Al, Si and V (may be referred to as "Al and the like" below).

The content of Ni and the total content of Al and the like are present in a predetermined region which will be described below.

The soft magnetic alloy according to the embodiment of the present invention may arbitrarily contain at least one of Cr and Mo, in addition to the essential elements of Ni, and Al and the like. Furthermore, the soft magnetic alloy according to the embodiment of the present invention may arbitrarily contain at least one element selected from the group consisting of Pb, Bi, Ca, Te, and Se, in addition to the essential elements of Ni, and Al and the like, and in further addition to at least one of Cr and Mo. The preferable content of each of the above elements will be described later.

Containing of the inevitable impurities is allowed in a range not impairing magnetic or electric characteristics of the soft magnetic alloy. Specific example of the inevitable impurities include, in terms of mass %:

C≤0.04%,
Mn≤0.3%,
P≤0.06%,
S≤0.06%,
N≤0.06%,
Cu≤0.1%,
Co≤0.06%, and
O≤1%.

The soft magnetic alloy according to the embodiment of the present invention can be produced in a manner that each component metal is smelted, and then rolling, forging, and the like are appropriately performed. Heat treatment such as magnetic annealing may be performed. Examples of a temperature during the magnetic annealing can include a temperature of from 800° C. to 1200° C.

(Component Composition in First Region)

In the soft magnetic alloy according to the embodiment of the present invention, the content of Ni and the total content of Al and the like have a predetermined relationship. Specifically, when the content of Ni is expressed by [Ni] and the total content of Al and the like (i.e., the total content of Al, Si and V) is expressed by [M], and a relationship between [Ni] and [M] is plotted, [Ni] and [M] are present in a predetermined first region. In the present specification, the content of each of the elements which include Ni, and Al and the like is expressed in mass % as a unit. The term "in" for each region includes a point on a boundary line which determines the region and a vertex.

FIG. 1 is a graph plotting [Ni] and [M]. Here, a first region is defined as a pentagonal region surrounded by a straight line A, straight line B, straight line C, straight line D, and straight line E. In FIG. 1, the corresponding reference symbol of each of the straight lines is indicated by a symbol in a circle.

Points 1 to 5 that respectively correspond to end points of the straight lines are defined as follows. Here, the element content in the case where the content of Ni is a mass % and the total content of Al and the like is b mass %, that is, a point at which [Ni]=a and [M]=b, is expressed by (a, b). In FIG. 1, the corresponding reference number of each of the points is indicated by a number in a square box.

Point 1 (0.1, 0.01)
Point 2 (11.0, 0.01)
Point 3 (11.0, 7.00)
Point 4 (3.0, 10.00)
Point 5 (0.1, 7.00)

Each of the straight lines is represented as a straight line connecting two points.

Straight line A: Point 1 and Point 2 ([M]=0.01)
Straight line B: Point 2 and Point 3 ([Ni]=11.0)
Straight line C: Point 3 and Point 4
Straight line D: Point 4 and Point 5
Straight line E: Point 5 and Point 1 ([Ni]=0.1)

Here, the reason for defining each of the straight lines A to E will be described.

Straight Line a and Straight Line E ([M]=0.01, [Ni]=0.1):

A condition of [M]≥0.01 and [Ni]≥0.1 is defined in order to obtain high saturated magnetic flux density while maintaining a coercive force low.

Specifically, in the case where [Ni] is 0.1 or larger ([Ni]≥0.1), it can be achieved B30000, which is a value of magnetic flux density measured under the external magnetic field H of 30,000 A/m, being 1.7 T or larger (B30000≥1.7 T). Here, B30000 is a value capable of being approximate to saturated magnetic flux density in this kind of soft magnetic alloy. Even if magnetic flux density is not saturated in H of 30,000 A/m, the saturated magnetic flux density should be larger than B30000. Thus, B30000 can be considered as a lower limit value of the saturated magnetic flux density. In the soft magnetic alloy according to the embodiment of the present invention, the saturated magnetic flux density (B30000) is preferably 1.7 T or larger, and more preferably 2.0 T or larger.

However, in an iron-based alloy which includes only Ni as the additive element, if [Ni] is 0.1 or larger, a crystal structure has an α phase+γ phase or a martensite phase and thus, the coercive force Hc exceeds 1,000 A/m and becomes higher. Therefore, by adding an element selected from the group consisting of Al, Si and V and setting [M] to be 0.01 or larger ([M]≥0.01), generation of the α phase is accelerated, and a low coercive force satisfying Hc≤1,000 A/m can be secured. The α phase (ferrite phase) shows soft magnetism, but the γ phase (austenite phase) shows non-magnetism. If the martensite is contained, the coercive force becomes high. Al, Si and V are elements that accelerate the generation of ferrite and can improve soft magnetic characteristics of an alloy.

Straight Line B ([Ni]=11.0):

As described above, the saturated magnetic flux density can be increased by setting the content of Ni to be 0.1% or larger. However, if too much Ni is contained, reversely, the saturated magnetic flux density is decreased. B30000≥1.7 T can be secured by satisfying [Ni]≤11.0. A low coercive force of Hc≤1,000 A/m can also be ensured.

Straight Line C and Straight Line D:

B30000≥1.7 T can be secured by controlling the content of Ni and the total content of Al and the like to the values inside the region defined by the straight line C and the straight line D.

As described above, the soft magnetic alloy according to the embodiment of the present invention has high saturated magnetic flux density and a low coercive force, and exhibits excellent soft magnetic characteristics. In addition, the soft magnetic alloy has high hardness. For example, the Vickers hardness Hv can be set to be 150 or larger, 250 or larger, and 350 or larger. It is estimated that such high hardness is exhibited by the soft magnetic alloy containing Ni, and Al and the like.

(Component Composition in Second Region)

In the soft magnetic alloy according to the embodiment of the present invention, it is preferable that [Ni] and [M] are present in a second region which is in the first region.

As shown in FIG. 1, the second region is defined as a hexagonal region surrounded by the following straight line F and straight line G in addition to the straight line A, straight line C, straight line D, and straight line E.

The straight line F is defined as a straight line connecting Point 6 and Point 7.

Point 6 (1.0, 0.01)

Point 7 (6.5, 3.50)

The straight line G is defined as a straight line corresponding to [Ni]=6.5. Here, the element content at Point p corresponding to an intersection point of the straight line G and the straight line C is about Point p (6.5, 8.7).

Here, the reason for defining the straight lines F and G will be described.

Straight line F:

The α phase in the crystal structure is easily maintained by controlling the content of Ni and the total content of Al and the like to the values inside the region defined by the straight line F. As a result, the coercive force Hc can be suppressed in a low level. In particular, the coercive force Hc is easily reduced to a low level of Hc≤500 A/m. For example, even though heat treatment is performed at 850° C., which is known as a general temperature during magnetic annealing of an electromagnetic steel sheet, it is possible to maintain the α phase to a high degree. In the case where the content of Ni and/or Al and the like is a value outside the region defined by the straight line F, the α phase+γ phase or the martensite phase is easily formed and the coercive force Hc is increased. Thus, in particular, when magnetic annealing is performed at a high temperature, the desired soft magnetic characteristics are hardly exhibited.

Straight Line G ([Ni]=6.5):

In the case where [Ni] is 6.5 or smaller, the high saturated magnetic flux density of B30000≥1.7 T is easily secured in particular. In the case of [Ni]>6.5, Hc≤500 A/m can be secured, but simultaneous achieving of Hc≤500 A/m and B300002≥1.7 T may be difficult in some cases.

Furthermore, magnetic permeability can be improved by setting the content of Ni and the total content of Al and the like within the second region. For example, specific magnetic permeability μ can satisfy μ>1000.

(Component Composition in Third Region)

In the soft magnetic alloy according to the embodiment of the present invention, it is preferable that [Ni] and [M] are present in a third region which is in the second region.

As shown in FIG. 1, the third region is defined as a pentagonal region surrounded by the following straight line H and straight line I in addition to the straight line D, straight line E and straight line G.

The straight line H is defined as a straight line connecting Point 8 and Point 7.

Point 8 (0.1, 0.50)

Point 7 (6.5, 3.50)

The straight line I is defined as a straight line connecting Point 9 and Point 4.

Point 9 (6.5, 7.00)

Point 4 (3.0, 10.00)

In the case where the content of Ni and the total content of Al and the like are present in the third region, the soft magnetic alloy is excellent in the effect of reducing the coercive force Hc to be low due to the maintenance of the α phase in particular, and Hc≤500 A/m is easily satisfied. For example, even though heat treatment is performed at 1100° C., which is known as a general temperature during magnetic annealing of permendur, it is possible to maintain the α phase to a high degree.

(Addition of Cr or Combination of Cr and Mo)

The soft magnetic alloy according to the embodiment of the present invention may only contain the essential addition elements of Ni and at least one element selected from a group consisting of Al, Si and V in amounts within the first region (or second region or third region) in addition to Fe and inevitable impurities. However, the soft magnetic alloy according to the embodiment of the present invention may further contain at least one of Cr and Mo as an optional element. If the soft magnetic alloy contains at least one of Cr and Mo, electric resistance and corrosion resistance of the soft magnetic alloy can be improved. The soft magnetic alloy may contain either of Cr and Mo, or may contain both Cr and Mo. In view of efficiently improve corrosion resistance, it is preferable that the soft magnetic alloy contains at least Cr.

In the case of containing Cr, the content of Cr is set to be 1%≤Cr≤14%. In the case where the content of Cr is 1% or larger, it is possible to achieve electric resistivity ρ to be a high value of ρ≥70 μΩcm. By increasing the electric resistance, eddy current loss in the soft magnetic alloy can be reduced. Furthermore, Cr has an effect of decreasing the coercive force Hc. In the case where the content of Cr is 1% or larger, Hc≤500 A/m is easily achieved.

However, if the content of Cr is increased too much, the saturated magnetic flux density is easily decreased. Such a high saturated magnetic flux density as B30000≥1.7 T can be secured by setting the content of Cr to be 14% or smaller. In the case of Cr≤9%, the high saturated magnetic flux density is maintained more easily. On the other hand, in the case of Cr>9%, Cr≤10%, and particularly Cr≤12%, an especially high effect of improving the electric resistivity and the corrosion resistance can be obtained.

In the case of containing Mo, the content of Mo is preferably set to be 1%≤Mo≤6%. In the case where the content of Mo is 1% or larger, an excellent effect of improving the electric resistivity and the corrosion resistance can be obtained. In the case where the content of Mo is 6% or smaller, the high saturated magnetic flux density can be secured.

As described above, it is preferable that the soft magnetic alloy contains at least Cr, and in the case of adding Mo, it is preferable that the contents of Cr and Mo satisfy 1%≤Cr≤14% and 1%≤Mo≤6%, respectively. Such an embodiment of containing both Cr and Mo can be regarded as an embodiment where a combination of Cr and Mo obtained by replacing a portion of Cr with Mo is added in a soft magnetic alloy. Mo has an excellent effect of increasing the electric resistance and the corrosion resistance as compared to Cr. Thus, even in a small addition amount, Mo can provide high effect. From this viewpoint, in the case where the combination of Cr and Mo is employed, it is more preferred that Cr and Mo are added so as to make the sum value of the content of Cr and 3.3 times the content of Mo to be equal to the amount of Cr in the case of employing only Cr. That is, from a viewpoint of improving the electric resistance and the corrosion resistance while securing the high saturated magnetic flux density, the contents may be set to satisfy 1%≤Cr+3.3Mo≤14%. Furthermore, from a viewpoint of maintaining the high saturated magnetic flux density to a higher degree, the contents may be set to satisfy Cr+3.3Mo≤9%. On the other hand, from a viewpoint of obtaining especially high electric resistivity and corrosion resistance, the contents may be set to satisfy Cr+3.3Mo>9%, particularly Cr+3.3Mo≤10%, and more preferably Cr+3.3Mo≤12%. The reduction of the content of Cr by using Mo in combination contributes to maintaining a large magnetic flux density.

(Other Addition Elements)

The soft magnetic alloy according to the embodiment of the present invention may further contain at least one element selected from the following group as second optional element, in addition to the essential elements of Ni and at least one element selected from a group consisting of Al, Si and V, or in addition to these essential elements and optional elements of at least one of Cr and Mo:

0.03%≤Pb≤0.30%,
0.002%≤Bi≤0.020%,
0.002%≤Ca≤0.20%,
0.01%≤Te≤0.20%, and
0.03%≤Se≤0.30%.

Machinability of the soft magnetic alloy can be improved by adding at least one element selected from the group of the second optional elements. The lower limits of the respective second optional elements are defined as the contents of capable of providing the effect of improving machinability. On the other hand, the upper limits of the respective second optional elements are defined as the contents of capable of avoiding the reduction in magnetic characteristics.

Examples

The present invention will be more specifically described by using examples.

Respective soft magnetic alloys having component compositions (unit: mass %) shown in Tables 1 and 2 were prepared as Examples A1 to A12 and B1 to B18, and Comparative Examples 1 to 9. In addition, as for some of the soft magnetic alloys of the B-group Examples shown in Table 2, corresponding soft magnetic alloys of B'-group Examples were prepared by adding an addition element shown in Table 3. In each component composition, the balance was Fe and inevitable impurities. Specifically, metal materials having the corresponding composition ratio were smelted in a vacuum induction furnace, and thereon were performed casting and hot forging. Machining was performed to have a shape of a measurement test piece used in the following tests, and then magnetic annealing was performed at 850° C.

On the measurement test pieces obtained in this manner, measurement of each of the magnetic flux density B30000, the coercive force Hc, the electric resistivity ρ, and the hardness, and evaluation of the corrosion resistance were performed. Furthermore, on some of the measurement test pieces, evaluation of the machinability was also performed. A method for each of the tests will be described below.

<Measurement of Magnetic Flux Density>

The soft magnetic alloy was machined to have a cylindrical shape of 28 mm in outer diameter, 20 mm in inner diameter, and 3 mm in thickness t, thereby prepare a magnetic ring (iron core). A primary coil (480 turns) and a secondary coil (20 turns) were formed by using the magnetic ring, and the formed coils were used as measurement samples. The magnetic flux density was measured by using a magnetic measuring instrument ("BH-1000" manufactured by Denshijiki Industry Co., Ltd.). The magnetic flux density was measured in such a manner that a current was made to flow in the primary coil so as to generate a magnetic field H around the magnetic ring, and the magnetic flux density generated in the magnetic ring was calculated based on an integrated value of a voltage induced in the secondary coil. In this measurement, the magnetic field H was set to be 30,000 A/m and B30000 as the value of the magnetic flux density at this time was recorded.

<Measurement of Coercive Force>

A magnetization curve (B-H curve) was measured by using the same measurement sample and the same magnetic measuring device as those used in the measurement of the magnetic flux density. The coercive force Hc was estimated based on the obtained hysteresis loop.

<Measurement of Electric Resistivity>

The soft magnetic alloy was machined to have a prism shape of 10 mm square in cross section and 30 mm in length. Then, the electric resistivity was measured. The measurement was performed by using a four-terminal method.

<Evaluation of Corrosion Resistance>

The corrosion resistance of the soft magnetic alloy was evaluated by a salt spray test defined in JIS Z 2371. That is, salt spray was performed, and after 24 hours elapsed, the surface of the sample was visually observed. A proportion of an area of a region in which an occurrence of rust was confirmed was estimated as a rust incidence. As the value of the rust incidence becomes small, high corrosion resistance is achieved.

<Measurement of Hardness>

The soft magnetic alloy was machined to have a size of 1 cm cube, buried in resin, and then polished. The Vickers hardness (Hv) of the sample piece was measured by using a Vickers hardness tester.

<Evaluation of Machinability>

Machinability test was performed on the soft magnetic alloys of some of the B-group Examples and of the B'-group Examples, and machinability thereof was evaluated. That is, a plate shaped sample of 5 mm in thickness was prepared, and thereon were formed through-holes by using a drill of 2 mm in diameter until the drill gets worn and becomes unable to form a through-holes any more. The total number of the through-holes formed was counted to evaluate machinability of the sample. The machining rate was set to be 20 m/min. The case where 81 or more of through-holes can be formed was evaluated as "Excellent", the case where 51 or more and 80 or less of through-holes can be formed was evaluated as "Good", and the case where only 50 or less of through-holes can be formed was evaluated as "Poor".

<Results>

Table 1 shows the component compositions and results of the above tests for the soft magnetic alloys in Examples A1 to A12 and Comparative Examples 1 to 9. As for Examples A1 to A10, the content of Ni and the total content of Al and the like correspond to Point 1 to Point 10, respectively, indicated by the number in a square box in FIG. 1. As for Comparative Examples 2 to 9, the content of Ni and the total content of Al and the like correspond to points indicated by the number in parentheses. Comparative Example 1 corresponds to pure iron.

According to Table 1, in each of Examples in which the content of Ni and the total content of Al and the like are present in the first region, the magnetic flux density B30000 was 1.7 T or larger and the coercive force Hc was 1,000 A/m or lower. That is, it is indicated that in the case where Ni and at least one element selected from the group consisting of Al, Si and V are added to Fe in contents in the first region, an excellent soft magnetic alloy having a low coercive force and high saturated magnetic flux density can be obtained. Furthermore, in the comparison between Example A10 and Examples A11 and A12, which are different from each other only in an aspect of whether or not Cr and Mo are added, it can be found that in the case where Cr or Mo was added as in Examples A11 and A12, high electric resistance and high corrosion resistance were achieved while maintaining the high magnetic flux density and the low coercive force.

On the contrary, in Comparative Example 1 using pure iron, the high magnetic flux density and the low coercive force were achieved, but the corrosion resistance was poor and the electric resistivity ρ was also low. In Comparative Example 2 in which Al, Si and V were not contained and much of Ni was contained, the magnetic flux density B30000 was a high value, but the coercive force Hc exceeded 1,000 and the soft magnetic characteristics were poor. In Comparative Example 3, since Al was contained but the content thereof was too small, the coercive force Hc was also high. Even in Comparative Examples 4, 8 and 9, since the content of Ni was too much, the coercive force Hc was high. Comparative Examples 4, 8 and 9 contained Al, Si and V, respectively, as an addition element other than Ni. Comparative Examples 4, 8 and 9 are similar to each other in contents of Ni and the respective addition element, and thus, they all showed the large coercive force Hc exceeding 2,000 A/m. In Comparative Examples 5 and 6, the content of Ni and the content of Al were positioned in a region outside the

TABLE 1

| | | Component composition | | | | | | Evaluation result | | | | |
|---|---|---|---|---|---|---|---|---|---|---|---|---|
| | | Ni | Al | Si | V | Cr | Mo | Magnetic flux density B30000 [T] | Coercive force Hc [A/m] | Electric resistivity ρ [μΩ · cm] | Rust incidence [%] (corrosion resistance) | Hardness [Hv] |
| Example | A1 | 0.1 | 0.01 | — | — | — | — | 2.03 | 870 | 17 | 85 | 160 |
| | A2 | 11.0 | — | 0.01 | — | — | — | 2.10 | 440 | 31 | 60 | 390 |
| | A3 | 11.0 | — | — | 7.00 | — | — | 1.75 | 150 | 88 | 66 | 401 |
| | A4 | 3.0 | — | 10.00 | — | — | — | 1.73 | 140 | 91 | 69 | 400 |
| | A5 | 0.1 | 7.00 | — | — | — | — | 1.72 | 175 | 63 | 71 | 320 |
| | A6 | 1.0 | 0.01 | — | — | — | — | 1.90 | 190 | 23 | 75 | 220 |
| | A7 | 6.5 | 3.50 | — | — | — | — | 1.82 | 178 | 43 | 60 | 351 |
| | A8 | 0.1 | 0.50 | — | — | — | — | 1.95 | 150 | 28 | 85 | 200 |
| | A9 | 6.5 | 7.00 | — | — | — | — | 1.74 | 198 | 55 | 45 | 380 |
| | A10 | 4.0 | 4.00 | — | — | — | — | 1.90 | 104 | 48 | 65 | 350 |
| | A11 | 4.0 | 4.00 | — | — | 9.00 | — | 1.70 | 244 | 90 | 0 | 350 |
| | A12 | 4.0 | 4.00 | — | — | 1.00 | 3.00 | 1.85 | 104 | 61 | 30 | 330 |
| Comparative Example | 1 | — | — | — | — | — | — | 2.00 | 200 | 15.5 | 95 | 101 |
| | 2 | 15.0 | — | — | — | — | — | 1.99 | 1129 | 35 | 85 | 200 |
| | 3 | 5.0 | 0.005 | — | — | — | — | 2.20 | 2100 | 20 | 90 | 201 |
| | 4 | 12.0 | 0.50 | — | — | — | — | 1.80 | 2350 | 30 | 86 | 230 |
| | 5 | 10.0 | 10.00 | — | — | — | — | 1.50 | 300 | 50 | 65 | 390 |
| | 6 | 0.3 | 9.00 | — | — | — | — | 1.45 | 250 | 45 | 60 | 290 |
| | 7 | — | 5.00 | — | — | — | — | 1.55 | 345 | 40 | 77 | 250 |
| | 8 | 12.0 | — | 0.50 | — | — | — | 2.15 | 2250 | 25 | 88 | 235 |
| | 9 | 12.5 | — | — | 0.60 | — | — | 2.10 | 2100 | 30 | 90 | 240 |

straight line C and the straight line D that define the first region. Therefore, the magnetic flux density B30000 was smaller than 1.7 T. Also in Comparative Example 7, since Ni was not contained, the magnetic flux density B30000 was smaller than 1.7 T.

Table 2 shows the component compositions and results of the above tests for the soft magnetic alloys in Examples B1 to B18 which include cases where the contents of Cr and/or Mo are increased.

content of Al with each other, the electric resistivity was higher in Example B13 with the larger value of Cr+3.3Mo. Furthermore, Examples B15 to B18 are the same in the contents of Ni and Al with each other, but different in the value of Cr+3.3Mo. That is, Examples B15 to B17 have the larger value of Cr+3.3Mo than Example B18. In the comparison between Examples B15 to B18, it can be found that the high corrosion resistance was achieved in Examples B15 to B17 as compared with Example B18.

TABLE 2

| | Component composition | | | | | | | Evaluation result | | | | |
|---|---|---|---|---|---|---|---|---|---|---|---|---|
| | Ni | Al | Si | V | Cr | Mo | Cr + 3.3 Mo | Magnetic flux density B30000 [T] | Coercive force Hc [A/m] | Electric resistivity ρ [μΩ · cm] | Rust incidence [%] (corrosion resistance) | Hardness [Hv] |
| Example B1 | 2.0 | 0.50 | — | — | 9.00 | — | 9.00 | 1.9 | 290 | 54 | 7 | 260 |
| B2 | 7.5 | — | 0.50 | — | 9.00 | — | 9.00 | 1.8 | 280 | 65 | 5 | 280 |
| B3 | 2.0 | — | — | 0.50 | 13.00 | — | 13.00 | 1.8 | 235 | 70 | 0 | 255 |
| B4 | 2.0 | 3.00 | — | — | 9.00 | — | 9.00 | 1.8 | 140 | 70 | 4 | 330 |
| B5 | 2.0 | 0.50 | — | — | 9.00 | 0.50 | 10.65 | 1.9 | 275 | 56 | 4 | 275 |
| B6 | 3.0 | 2.00 | — | — | 12.00 | — | 12.00 | 1.8 | 156 | 77 | 0 | 301 |
| B7 | 3.0 | 1.50 | — | — | 12.00 | — | 12.00 | 1.9 | 211 | 74 | 0 | 330 |
| B8 | 2.0 | 1.50 | — | — | 12.00 | — | 12.00 | 1.9 | 285 | 62 | 0 | 320 |
| B9 | 3.0 | 2.00 | — | — | 7.00 | 2.00 | 13.60 | 1.8 | 85 | 78 | 0 | 333 |
| B10 | 0.99 | 1.99 | — | — | 9.01 | 1.60 | 14.29 | 1.7 | 106 | 87 | 0 | 169 |
| B11 | 1.0 | 1.98 | — | — | 4.98 | 1.61 | 10.29 | 1.9 | 92 | 72 | 4 | 164 |
| B12 | 0.96 | 0.95 | — | — | 6.79 | 4.27 | 20.88 | 1.8 | 238 | 72 | 0 | 181 |
| B13 | 0.96 | 0.96 | — | — | 6.66 | 5.09 | 23.46 | 1.8 | 245 | 74 | 0 | 184 |
| B14 | 0.98 | 1.95 | — | — | 4.98 | 3.13 | 15.31 | 1.8 | 191 | 78 | 0 | 182 |
| B15 | 1.0 | 1.0 | — | — | 7.00 | 3.70 | 19.21 | 1.8 | 203 | 71 | 0 | 184 |
| B16 | 1.0 | 1.0 | — | — | 7.00 | 4.00 | 20.20 | 1.8 | 215 | 72 | 0 | 186 |
| B17 | 1.0 | 1.0 | — | — | — | 6.00 | 19.80 | 1.9 | 220 | 50 | 0 | 225 |
| B18 | 1.0 | 1.0 | — | — | — | 1.00 | 3.30 | 2.0 | 180 | 33 | 8 | 150 |

According to Table 2, it is understood that in the case where the content of Cr (or Cr+3.3Mo) was larger than 9% as in Examples B1 to B17, especially high electric resistivity and corrosion resistance were achieved. In particular, in the comparison between Example B1 and Example B3, which are the same in the contents of Ni and Al or V but different in the content of Cr with each other, it can be found that the electric resistivity and the corrosion resistance were improved in Example B3 with the larger content of Cr. A decrease in the coercive force was also observed. Also in the comparison between Example B10 and Example B11, which are almost the same in the contents of Ni, Al and Mo, it can be found that the electric resistivity and the corrosion resistance were improved in Example B10 with the larger content of Cr.

In the comparison between Example B1 and Example B5, which are different only in a point of whether or not Mo is added, it can be found that in the case where Mo was added in addition to Cr, an increase in the electric resistivity and the corrosion resistance were achieved. Also in the comparison between Example B17 and Example B18, which are the same in the contents of Ni and Al and do not contain Cr, it can be found that the electric resistivity and the corrosion resistance were improved in Example B17 with the larger content of Mo. In addition, although Examples B12 and B13 are the same in the content of Ni and almost the same in the Examples B10 to B18 showed low hardness as compared with Examples B1 to B9. The present inventors consider that this is because Examples B10 to B18 had a content ratio of Al/Ni being large such as 1 or larger and thus, there is a large contribution from ferrite structure. However, in Examples B10 to B18, the magnetic flux density could be maintained large even with a small content of Ni by setting the content of Cr to be relatively low or by containing no Cr. Then, the electric resistivity and the corrosion resistance were maintained high even with such a small content of Cr by setting the value of Cr+3.3Mo to be large by adding Mo.

In addition, the soft magnetic alloys of Examples B1', B2', B5', B6', B8', and B11' were prepared by adding at least one element selected from the group consisting of Pb, Bi, Ca, Te, and Se into the component compositions of Examples B1, B2, B5, B6, B8, and B11, respectively, shown in Table 2. The relation between machinability and the presence or absence of these addition elements was evaluated. Table 3 shows the component compositions and the evaluation result of machinability. Incidentally, although the data are not provided in Table 3, the present inventors had confirmed that all B'-group Examples containing the addition element showed similar levels of magnetic flux density, coercive force, electric resistivity, corrosion resistance, and hardness with these obtained in the corresponding B-group Examples as shown in Table 2.

TABLE 3

| | Component composition | | | | | | | | Evaluation result |
|---|---|---|---|---|---|---|---|---|---|
| | Ni | Al | Si | V | Cr | Mo | Cr + 3.3 Mo | Other addition element | Machinability |
| Example B1 | 2.0 | 0.50 | — | — | 9.00 | — | 9.00 | — | Good |
| B1' | | | | | | | | Pb: 0.09 | Excellent |
| B2 | 7.5 | — | 0.50 | — | 9.00 | — | 9.00 | — | Good |
| B2' | | | | | | | | Bi: 0.01 | Excellent |
| B5 | 2.0 | 0.50 | — | — | 9.00 | 0.50 | 10.65 | — | Good |
| B5' | | | | | | | | Bi: 0.01<br>Ca: 0.007 | Excellent |
| B6 | 3.0 | 2.00 | — | — | 12.00 | — | 12.00 | — | Good |
| B6' | | | | | | | | Pb: 0.06<br>Te: 0.08 | Excellent |
| B8 | 2.0 | 1.50 | — | — | 12.00 | — | 12.00 | — | Good |
| B8' | | | | | | | | Pb: 0.05<br>Ca: 0.005<br>Se: 0.15 | Excellent |
| B11 | 1.0 | 1.98 | — | — | 4.98 | 1.61 | 10.29 | — | Good |
| B11' | | | | | | | | Pb: 0.07 | Excellent |

According to Table 3, even in B-group Examples containing no element selected from the group consisting of Pb, Bi, Ca, Te, and Se, relatively good machinability was achieved. However, it is understood that in B'-group Examples containing at least one element selected from the group consisting of Pb, Bi, Ca, Te, and Se, machinability was significantly improved. That is, it was confirmed that Pb, Bi, Ca, Te, and Se has an effect of improving machinability of a soft magnetic alloy.

While the present invention has been described in detail and with reference to specific embodiments and Examples thereof, it will be apparent to one skilled in the art that various changes and modifications can be made therein without departing from the spirit and scope thereof.

The present application is based on Japanese Patent Application No. 2016-136661, filed on Jul. 11, 2016 and Japanese Patent Application No. 2017-116521 filed on Jun. 14, 2017, the entirety of which is incorporated herein by reference.

What is claimed is:

1. A soft magnetic alloy, consisting of:

2.1 mass %≤Ni≤11.0 mass %;

1.0 mass %≤Mo≤6 mass %;

1.5 mass %≤Al≤10.0 mass %;

1.0 mass %≤Cr≤14.0 mass %; and optionally, at least one element selected from the group consisting of:

0.03 mass %≤Pb≤0.03 mass %;

0.002 mass %≤Bi≤0.020 mass %;

0.002 mass %≤Ca≤0.20 mass %;

0.01 mass %≤Te≤0.20 mass %; and 0.03 mass %≤Se≤0.30 mass %, with a balance being Fe and inevitable impurities such that Mn≤0.3 mass % and C≤0.04 mass % in the soft magnetic alloy, wherein, when a content of Ni and a content of Al are expressed by [Ni] and [M], respectively in mass %, and further satisfies a relationship between [Ni] and [M] plotted in a Cartesian coordinate with a linear interval, coordinate ([Ni], [M]) is present in a region surrounded by the following straight line A, the following straight line B, the following straight line C, the following straight line D, and the following straight line E:

Straight line A: [M]=0.01;

Straight line B: [Ni]=11.0;

Straight line C: a straight line connecting a point at which ([Ni], [M]) is (11.0, 7.00) and a point at which ([Ni], [M]) is (3.0, 10.00);

Straight line D: a straight line connecting a point at which ([Ni], [M]) is (3.0, 10.00) and a point at which ([Ni], [M]) is (0.1, 7.00); and Straight line E: [Ni]=2.1, wherein the soft magnetic alloy has a Vickers hardness Hv of 250 or higher;

wherein the soft magnetic alloy has a saturated magnetic flux density is 1.7 T or higher, and wherein the saturated magnetic flux density is a value measured under the external magnetic field H of 30,000 A/m.

2. A soft magnetic alloy, consisting of:

2.1 mass %≤Ni≤11.0 mass %;

1.0 mass %≤Mo≤6 mass %;

1.5 mass %≤Al≤10.0 mass %;

1.0 mass %≤Cr≤14.0 mass %, with a balance being Fe and inevitable impurities such that Mn≤0.3 mass % and C≤0.04 mass % in the soft magnetic alloy, wherein, when a content of Ni and a content of Al are expressed by [Ni] and [M], respectively in mass %, and further satisfies a relationship between [Ni] and [M] plotted in a Cartesian coordinate with a linear interval, a coordinate ([Ni], [M]) is present in a region surrounded by the following straight line A, the following straight line B, the following straight line C, the following straight line D, and the following straight line E:

Straight line A: [M]=0.01;

Straight line B: [N]=11.0;

Straight line C: a straight line connecting a point at which ([Ni], [M]) is (11.0, 7.00) and a point at which ([Ni], [M]) is (3.0, 10.00);

Straight line D: a straight line connecting a point at which ([Ni], [M]) is (3.0, 10.00) and a point at which ([Ni], [M]) is (0.1, 7.00); and Straight line E: [Ni]=2.1, wherein the soft magnetic alloy has a Vickers hardness Hv of 250 or higher;

wherein the soft magnetic alloy has a saturated magnetic flux density is 1.7 T or higher, and wherein the saturated magnetic flux density is a value measured under the external magnetic field H of 30,000 A/m.

3. The soft magnetic alloy according to claim 1, wherein the coordinate ([Ni], [M]) is present in a region surrounded by the straight line A, the straight line C, the straight line D, the straight line E, the following straight line F, and the following straight line G:

Straight line F: a straight line connecting a point at which ([Ni], [M]) is (1.0, 0.01) and a point at which ([Ni], [M]) is (6.5, 3.50); and Straight line G: [Ni]=6.5.

4. The soft magnetic alloy according to claim 3, wherein the coordinate ([Ni], [M]) is present in a region surrounded by the straight line D, the straight line E, the straight line G, the following straight line H, and the following straight line I:

Straight line H: a straight line connecting a point at which ([Ni], [M]) is (0.1, 0.50) and the point at which ([Ni], [M]) is (6.5, 3.50); and Straight line I: a straight line connecting a point at which ([Ni], [M]) is (6.5, 7.00) and the point at which ([Ni], [M]) is (3.0, 10.00).

5. The soft magnetic alloy according to claim 1, having, in mass %, at least one element selected from the group consisting of:

0.03%≤Pb≤0.30%;
0.002%≤Bi≤0.020%;
0.002%≤Ca≤0.20%;
0.01%≤Te≤0.20%; and
0.03%≤Se≤0.30%.

6. The soft magnetic alloy according to claim 1, satisfying 4.3 mass %≤Cr+3.3Mo≤14 mass %.

7. The soft magnetic alloy according to claim 2, satisfying 4.3 mass %≤Cr+3.3Mo≤14 mass %.

* * * * *